US008642866B1

(12) United States Patent
Belli et al.

(10) Patent No.: US 8,642,866 B1
(45) Date of Patent: Feb. 4, 2014

(54) MUSICAL INSTRUMENT HEAD MOUNTING DEVICE

(71) Applicants: Remo D. Belli, Valencia, CA (US); James H. May, Valencia, CA (US); Christopher J. Whittington, Valencia, CA (US)

(72) Inventors: Remo D. Belli, Valencia, CA (US); James H. May, Valencia, CA (US); Christopher J. Whittington, Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 13/573,864

(22) Filed: Oct. 10, 2012

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS

| | | | | |
|---|---|---|---|---|
| 4,583,442 | A | 4/1986 | Minor | |
| 5,349,891 | A | 9/1994 | Belli | |
| 5,600,080 | A | 2/1997 | Belli | |
| 6,580,023 | B2 | 6/2003 | Belli | |
| 7,074,994 | B2 | 7/2006 | Belli | |
| 7,151,211 | B2 | 12/2006 | Whittington | |
| 2010/0107853 | A1 * | 5/2010 | Bausch, III | 84/411 R |

* cited by examiner

*Primary Examiner* — Kimberly Lockett
(74) *Attorney, Agent, or Firm* — Larry F. Gitlin; Beaumont Gitlin Tashjian

(57) ABSTRACT

A musical drum instrument with a hollow shell having one or more openings, each having the capability of forming a circumferential bearing edge, and a head member having a playing surface. Also provided is a single tapered coupling with the narrowest portion of the tapered coupling situated in near proximity to at least one of the hollow shell openings or mating tapered couplings integrated with the outside surface of the shell wall and inside surface of the wall of the head member, respectively. The head member with or without the integrated tapered coupling is mounted upon the end of the hollow shell its integrated tapered couple with the head member and the hollow shell converging in frictional engagement to establish an airtight fit sealing the juncture where the two are joined to enable the direct transfer of energy produced upon the striking of the playing surface to enhance the sound quality of the musical instrument.

46 Claims, 21 Drawing Sheets

MUSICAL INSTRUMENT HEAD MOUNTING DEVICE

This is a continuation-in-part of application Ser. No. 13/573,146 filed Aug. 27, 2012, to be abandoned.

BACKGROUND OF THE INVENTION

1. Field of the Invention

The present invention relates generally to the field of musical drums and, more particularly, to an improved device for mounting the head portion of a percussion instrument to the instrument shell to form an airtight seal for, among other reasons, enhancing resonance.

2. Description of the Prior Art

In the prior art, percussive membranes, such as a drumhead of a musical drum, are replaceable when they become damaged, are no longer effective because of tension loss, the instrument is in need of an alternate sound, or for a variety of other reasons. The large majority of drumheads are attached to a drumshell and tuned with the use of tuning hardware, which typically includes a counterhoop that fits over the membrane, tension brackets that are mounted to the shell, and tension screws that link the counterhoop and tension brackets to enable the increase or decrease of the tensioning of the membrane for altering the drum sound (see e.g. U.S. Pat. No. 7,151,211 B2 issued to Whittington et al.; U.S. Pat. No. 7,074,994 B2 issued to Belli; U.S. Pat. No. 6,580,023 B2 issued to Belli; U.S. Pat. No. 5,600,080 issued to Belli; U.S. Pat. No. 5,349,891 issued to Belli; and U.S. Pat. No. 4,583,442 issued to Minor). Counterhoops and tensioning hardware, though effective and widely used, substantially increase the cost of the instrument as well as its weight, the latter reason still an important consideration for a drummer carrying the drum while playing the instrument or needing to transport it from one place to another. Lighterweight drums are still the drummer's preference if given a choice.

Easily replaceable vibrating membranes or, in this instance, drumheads, are advantageous because they enable the drummer to easily and quickly replace a drumhead to cater to a particular kind of music, such as, for example, rock, jazz, classical, contemporary, blues, and a variety of other music options.

Traditional drums, particularly those that have used wood and leather materials for drumheads before the advent of synthetic drumheads, typically used rope and similar materials for tuning the head. Accordingly, these drums, such as doumbeks, congas, bongos, djembes, ashikos and the like, were lighter in weight and relatively inexpensive. But they lacked the advantage of not being quickly tunable, or tunable in any precise manner. Also, a new head could easily require several hours to replace.

Then there are the double-sided drums that are commonly used in popular drum circles. The ability to easily and quickly remove one head from a double-sided drum, replace that head or even both heads, to produce a variety of different drum sounds, as the drum circle facilitator may require, is another advantage brought about by the improved device of the present invention. The ability to quickly remove a head from certain kinds of drums enables a set of drums shaped the same, but sized differently to nest inside one another to make transportation easier and to consolidate space for storage.

Another benefit of the improved device of the present invention, likely the most important, is the enhancement of the tonal qualities of the instrument by adding or ensuring the resonance of a particular frequency. One good example of this is the traditional African djembe, which creates sound waves that emanate from the head with certain other frequencies (generally lower bass tones) resonating through the vibrating air in the chamber of the drum body or shell. For the djembe and other drums with different configurations, especially those with sloping sidewalls with the sloping walls beginning near or at the top of the shell, to effectively produce these authentic and highly desirable sounds, the drumshell needs to be airtight, particularly at the point where the head and the shell are coupled, to ensure that the vibrating air maintains sufficient compression and is fully contained, at least momentarily, within the upper regions of the resonating shell, and then eventually throughout the entire drumshell interior chamber. The airtight seal is essential to produce an authentic and optimum sounding instrument. In addition, to enhance the authenticity of the drum sounds and control the production of sounds having higher frequencies, and the associated over ring, the bearing edge or some alternative structure performing a similar function formed circumferentially around or in near proximity to the top of the shell can be employed to engage the drumhead's vibrating membrane.

Prior art instruments, such as the Toca "Flex" drum, are much less effective than the improved device of the present invention simply because the gasket incorporated in the Flex drum is intended to compensate for any size discrepancies between the head and shell using a soft foam material for the gasket. Foam materials can create the requisite airtight seal, but compromise the drum sounds because of the extreme dampening effect inherent in that kind of material. Dampened vibrations severely undermine the richness and tonality of a particular instrument. Soft materials, like foam, also tend to wear down more quickly than other more resilient and sustainable materials, causing the airtight seal to deteriorate or leak, which results in the production of drum sounds that are much less resonant, less bass in tone, or rich sounding as they should or could be.

Another instrument known in the prior art is the Twice Percussion ashiko, which embodies a seal where the head and the shell connect with the use of a rubber shock cord, which is difficult to remove and install.

Accordingly, not until the conception and reduction to practice of the improved device of the present invention has there been a device embodying one or more tapered elements that integrate with the drumhead and the drumshell to enable and ensure a positive airtight seal where the drumhead and the drumshell, including also drumshells with sloping sidewalls, are coupled to enable the effective transfer of energy and, thus, the associated vibrations from the drumhead to the drumshell to produce a fully enriched authentic-sounding instrument that is exceptionally lightweight, inexpensive and desirably resonant.

SUMMARY OF THE INVENTION

In its preferred embodiment, the present invention provides a musical drum instrument with a head member having a playing surface with a circular frame member that is attached and gives shape to the playing surface and a hollow shell having a sidewall with an outside surface, an inside surface, and at least one end defining a first opening with a circumferential bearing edge portion.

Also provided is a tapered coupling member attached to or formed into, at least, one end of the drumshell, with the narrowest portion of the tapered coupling member located in near proximity or adjacent to the circumferential edge portion gradually expanding in width as it extends along the outside surface of the hollow shell in the direction away from the circumferential edge portion. The head member can be mounted upon either or both ends of the hollow shell, as may be appropriate, wherein the head member and the hollow shell can be releasably engaged to enable the head member and the hollow shell to establish an airtight fit to further enable the direct transfer of energy produced vibrations upon the striking of the playing surface. The energy produced from the head member to the hollow shell enhances the fullness and resonance (in the bass tones especially) and the ultimate sound of the musical instrument.

The present invention includes a variety of embodiments including, without limitation, one where the drumhead frame completely covers the tapered coupling to enable an airtight fit; another where the drumhead frame does not cover the entire tapered coupling, though still enabling an airtight fit; still another where a radius nib is formed at or extends from the top or upper end of the tapered coupling and the nib, rather than the bearing edge, actually makes contact with the periphery of the underside of the drumhead membrane to control excessive and undesirable high frequencies and over ring, again still enabling the requisite airtight fit; and still another where some space exists between the bearing edge and/or the radius nib and the underside of the playing surface to permit over ring caused by higher frequencies, which are typical of smaller drums intending this kind of result.

Accordingly, it is an object of the present invention to provide an improved musical instrument, particularly a musical drum, that incorporates a tapered coupling member to ensure an airtight seal at the point of connection where the drumhead and the drumshell are joined.

Another object of the present invention is to provide an improved musical instrument, particularly a musical drum, that incorporates a tapered coupling member with or integrates the coupling within the sloping sidewall of a drumshell to ensure an airtight seal at the point of connection where the drumhead and the drumshell are joined.

Another object of the present invention is to provide an improved musical instrument that enables a drumhead or another type of framed vibrating membrane to be easily and quickly removed from and installed on a musical drumshell or the like.

Another object of the present invention is to provide an improved musical instrument that enables a drummer to easily and quickly replace a drumhead or similar kind of framed vibrating membrane to cater to a particular kind of musical taste, such as, for example, rock, jazz, classical or contemporary music.

Another object of the present invention is to provide an improved musical instrument that enables the enhancement of the tonal qualities of the instrument by increasing the resonance of a particular desired frequency, especially those comprising the lower bass tones.

Another object of the present invention is to provide an improved musical instrument that enables a musical drum to produce authentic drum sounds in the shell's upper chamber regions by ensuring an airtight seal, particularly at the point of connection where the head and the shell are joined.

Another object of the present invention is to provide an improved musical instrument that enables a positive airtight seal at the point of connection between the drumhead or framed vibrating membrane and the shell or body, further enabling the transfer of vibrational energy from the struck drumhead to the shell and within to generate significant amounts of compressed vibrating air which, in turn, produces a fully enriched and authentic-sounding instrument that is exceptionally lightweight, inexpensive and resonant, especially in the lower bass tones.

Another object of the present invention is to provide an improved musical instrument that enables a positive airtight seal at the point of connection between the drumhead or framed vibrating membrane and the shell or body, and ensuring as well that the shell's bearing edge or another structure having a similar function contacts the vibrating membrane, further enabling the transfer of vibrational energy from the struck drumhead to the drumshell to produce a fully enriched sounding instrument across the higher range of tones with dampening control over the undesirable higher frequencies, and enhanced resonance in the lower bass tones.

Another object of the present invention is to provide an improved musical instrument that attaches or integrates a radius nib at the top or upper end of the tapered coupling member to enhance the instrument's quality of sound by alleviating or, at minimum, dampening undesirable higher frequencies.

Another object of the present invention is to provide a musical instrument where the framed membrane engages the shell, though just short of contact between the bearing edge or radius nib and the membrane, to sustain the pitch in the higher frequencies for smaller drums that often are intended to have this kind of enhancement.

Another object of the present invention is to provide a musical instrument, particularly a musical drum, that incorporates mating tapered couplings, with one disposed against the inside surface of the sidewall of the drumhead and the other disposed circumferentially along the sidewall of the drumshell, that are caused to frictionally engage in face opposed relation to ensure an airtight seal at the point of engagement where the drumhead and drumshell are joined.

Another object of the present invention is to provide an improved musical instrument that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
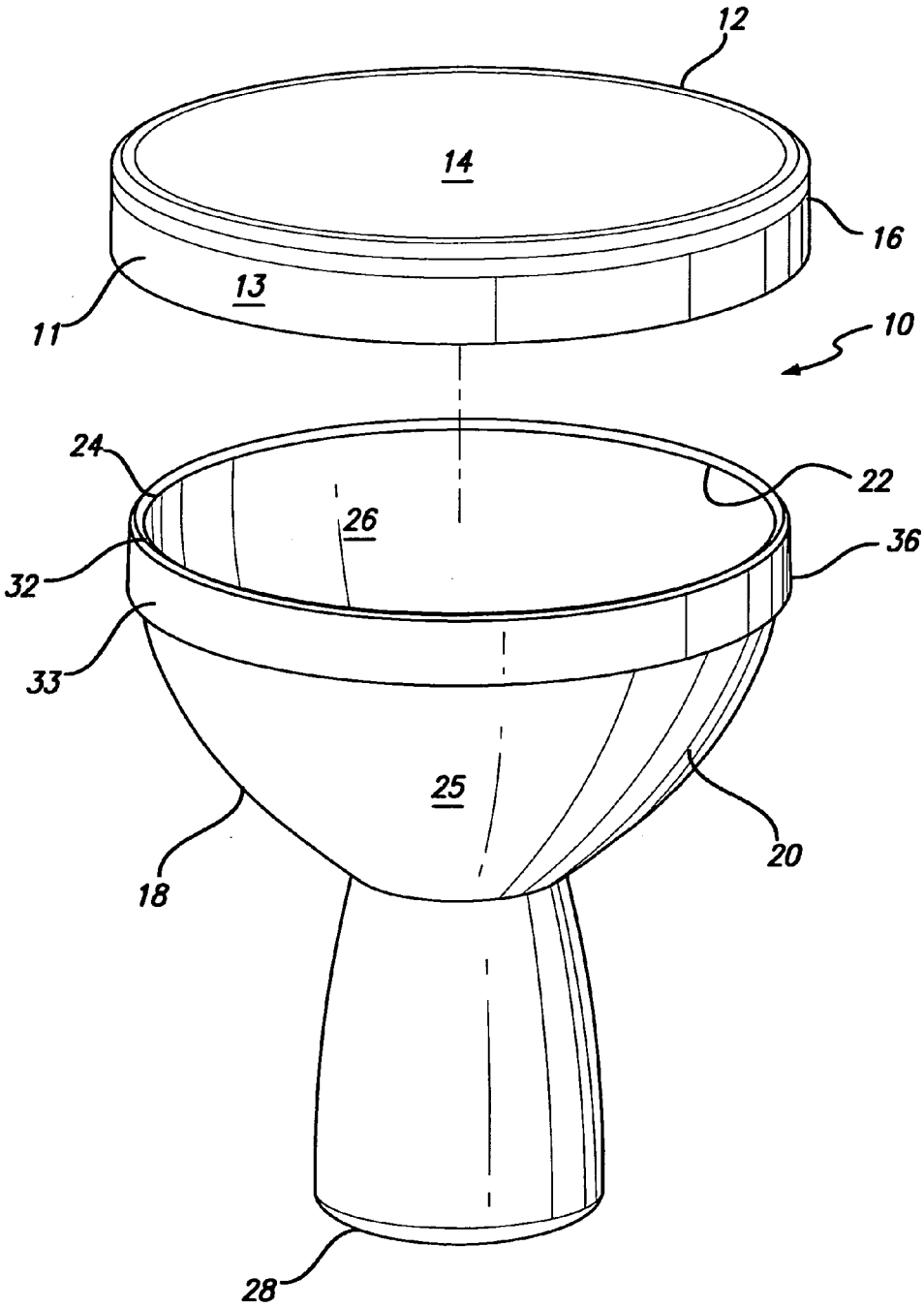
FIG. 1 is a front perspective view of the principal elements of the improved musical instrument in accordance with the present invention.
Figure 2:
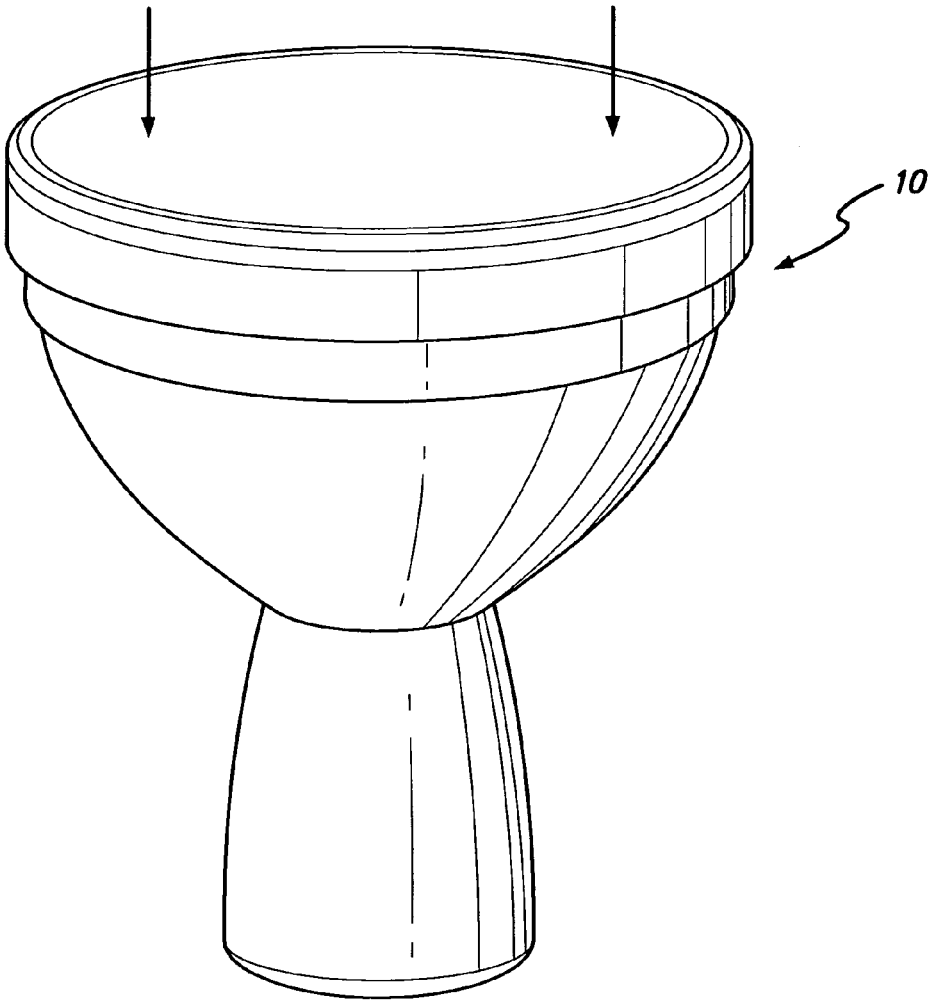
FIG. 2 is a front perspective view of the principal elements of the improved musical instrument shown in initial engagement in accordance with the present invention.
Figure 3:
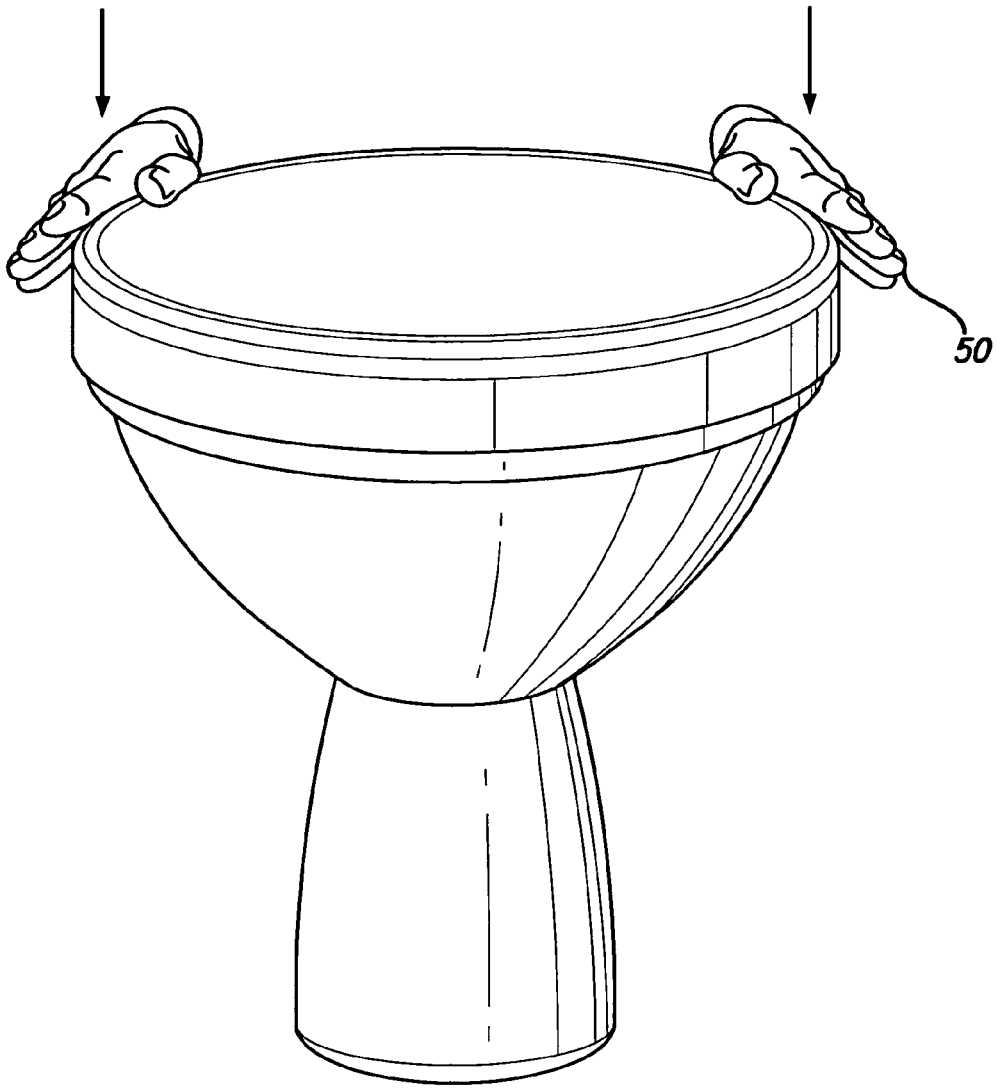
FIG. 3 is a front perspective view of the improved musical instrument with the principal elements shown in the final stage of engagement in sealing airtight relation in accordance with the present invention.
Figure 4:
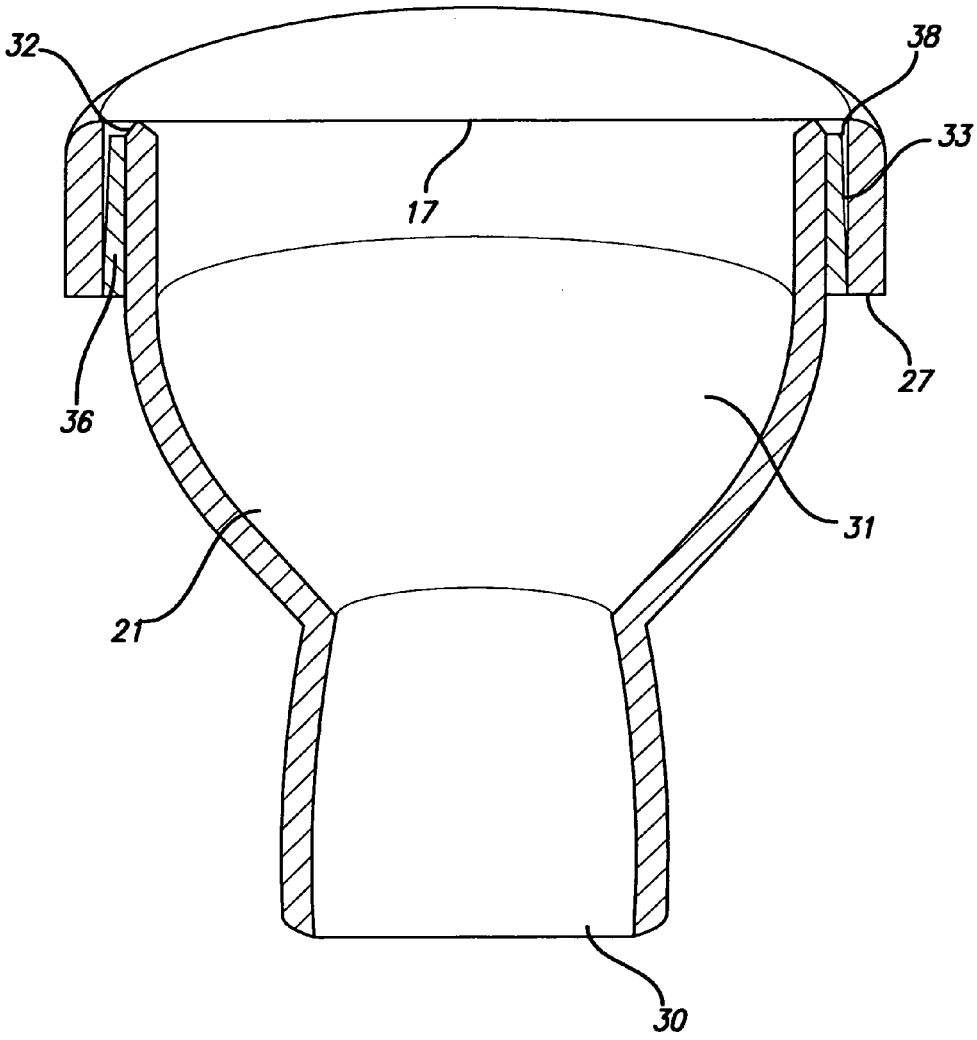
FIG. 4 is a cross-sectional view of the improved musical instrument in accordance with the present invention shown with the drumhead and the drumshell engaged in airtight relation and the bearing edge engaging the drumhead.
Figure 4A:
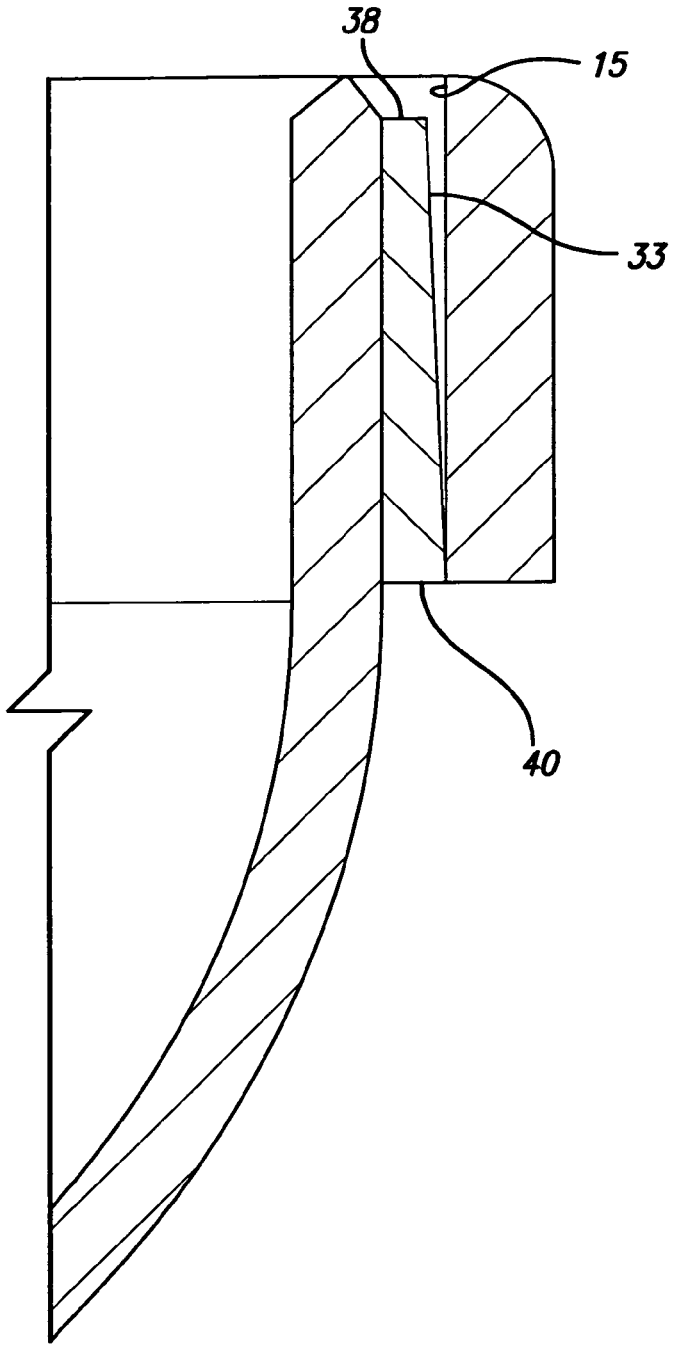
FIG. 4A is an enlarged cross-sectional view of a section of the improved musical instrument in accordance with the present invention.
Figure 4B:
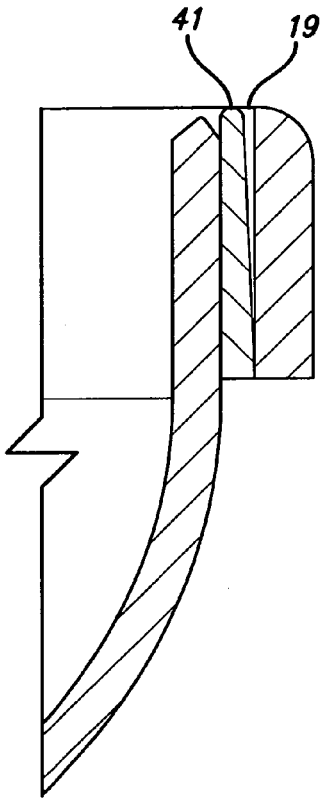
FIG. 4B is an enlarged cross-sectional view of the improved musical instrument in accordance with the present invention shown with the drumhead and the drumshell engaged in airtight relation and the radius nib engaging the drumhead.
Figure 4C:
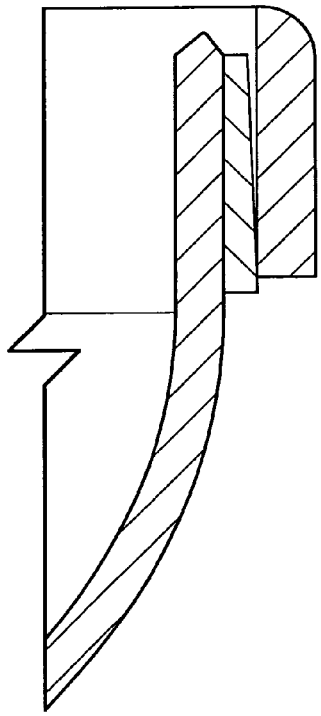
FIG. 4C is an enlarged perspective view of the improved musical instrument in accordance with the present invention shown with the drumhead and the drumshell engaged in airtight relation and a space between the bearing edge and the drumhead.

Musical instrument 10 includes a head member 12, which includes a normally pretuned playing surface 14, with an underside 17, attached to an annular frame member 16 by any suitable means including, but not limited to, staples, tacks, nails, and adhesives. Frame member 16, which supports and gives shape to playing surface 14, includes circumferential sidewall 11 with outer surface 13, inner surface 15, and bottom edge 27. Frame member 16 ranges in thickness from 3/16" to 3/8" to ensure sufficient rigidity and hardness to support the tension level of the film comprising playing surface 14 and, combined with the requisite resiliency, to withstand the forces compelling it to push out laterally when engaging hollow shell 18, as described in more detail below. Frame member 16 can be comprised of a wide variety of materials including, without limitation, a composite of wood fiber and resin, wood only, fiberglass, and plastic. Playing surface 14 can be comprised of several materials as well, including, without limitation, leather hides, and synthetic skins, which have the principal advantage of their resistance to unfavorable climate conditions.

Hollow shell 18 can be of any suitable configuration, often embodying a conical or goblet shape musical drumshell such as, for example, a djembe, ashiko, conga, bongo, doumbek, or even any conventional type of cylinder-shaped drum from a drumset (e.g. bass drum, snares and toms). Hollow shell 18, as shown incorporated with the djembe in FIG. 1, includes sidewall 25 having outside surface 20 and inside surface 22, and first end 24 defining first opening 26, second end 28 defining second opening 30, and chamber 21. Some drumshells, such as those having a conical shape, e.g. the ashiko and timbau, include sidewalls that are more aggressively sloped near the top section than, for example, the djembe or other types of shells with a more cylinder-like configuration. Openings 26 and 30 may include a circumferential bearing edge 32 for engaging underside 17 to alleviate or dampen high frequency drum sounds. Hollow shell 18 typically has a wall thickness ranging between 1/8" to 5/16" that can vary depending upon several factors, including the type and size of the instrument and the types of vibrational drum sounds and frequencies desired. Hollow shell 18 may be comprised of any suitable material including, but not limited to, wood, Acousticon® (an exclusive Remo product made of wood fiber and resin), fiberglass, plastic and metal alloy.

Attached to hollow shell 18 using any suitable means, including, without limitation, adhesives, staples, tacks, or screws, or molded or integrated directly into the shell material itself, utilizing, for example, the cast resin process, is tapered coupling member 36. Tapered coupling member 36 can be comprised of any one of an assortment of different materials, including, but not limited to, rigid plastic, a wood/fiber composite, urethane or epoxy resin (casting urethane) or exclusively wood. Tapered coupling member 36, which includes outside surface 33, is tapered with its narrowest portion at end 38 located in near proximity or adjacent to circumferential bearing edge 32 and then gradually widens or expands as it extends along outside surface 20 to its widest or most expansive point at end 40. A radius nib 41 may be included as an extension of end 38 of tapered coupling member 36 to engage the periphery 19 of underside 17 to produce a different kind of sound than the type of sound that would result when circumferential bearing edge 32 engages playing surface 14 some distance inside periphery 19.

The height or length of tapered coupling member 36 may range from less than 1/2" to as many as 5", or possibly more, depending on the size of the musical instrument, the relative dimensions of head member 12 and hollow shell 18, the slope of sidewall 25 situated near or at the top end of shell 18, any aesthetic requirements, the particular needs of the drummer or any one of several other factors. However, the primary objective is to ensure an airtight seal along the respective surfaces (i.e., inside surface 15 pressed tightly in sealing relation against outside surface 33) where head member 12 and hollow shell 18 engage, and that the two components are secure and do not unintentionally separate.

The preferred slope angle of tapered coupling member 36 ranges between just above 1° to 6°, depending on a variety of factors, including the relative dimensions of frame member 16, including the depth (or height) of sidewall 11, the diameter of head member 12, the diameter of hollow shell 18, the slope of sidewall 25 around the upper portion of shell 18, and the thickness of tapered coupling member 36. Taking these and possibly other factors into consideration the slope angle of the tapered coupling member 36 may vary to ensure a snug and secure airtight fit, as described.

To achieve the requisite airtight fit, head member 12 is mounted on hollow shell 18 by engaging either or both ends of the hollow shell, such as first end 24, and using one's hands 50 to push and manipulate head member 12 against said end, sliding frame member 16 along outside surface 33 of tapered coupling member 36 as the respective surfaces, i.e. inside surface 15 and outside surface 33, gradually meet resistance and begin to form an airtight seal as they engage, mate and become incrementally more tight fitting.

More particularly, an airtight seal is formed at the point where inside surface 15 of frame member 16 meets sufficient resistance as it gradually engages outside surface 33 of the incrementally widening or expanding portions of tapered coupling member 36 and cannot be moved further without greater effort and the risk of deforming the component parts resulting from excessive compression, which might make it more difficult to separate the two later. This condition is considered the natural stopping point because the airtight seal, the primary objective, has reached its pinnacle effectiveness.

The airtight seal is formed concurrent with the occurrence of any one of several principal embodiments of the present invention. This will occur, for example, when circumrential bearing edge 32 makes contact with underside 17, which enables instrument 10 to produce limited high tones, though largely with the avoidance of over ring, which result from undesirable high frequencies, as well as resonating lower bass tones in the upper region 31 of chamber 21.

Another of these embodiments involves contact with the nearly outermost periphery of underside 17 of playing surface 14 by radius nib 41, which results in the production of controlled high frequencies that sound differently from those produced when circumferential bearing edge 32, which engages underside 17 a slight distance inside the periphery, contacts the playing surface.

Yet another occurs when circumferential bearing edge 32 does not contact underside 17, specifically where some space is left between the two, enabling a higher pitch or relatively uncontrolled higher frequencies to persist, which are often the desired objective of smaller drums.

Figure 6A:
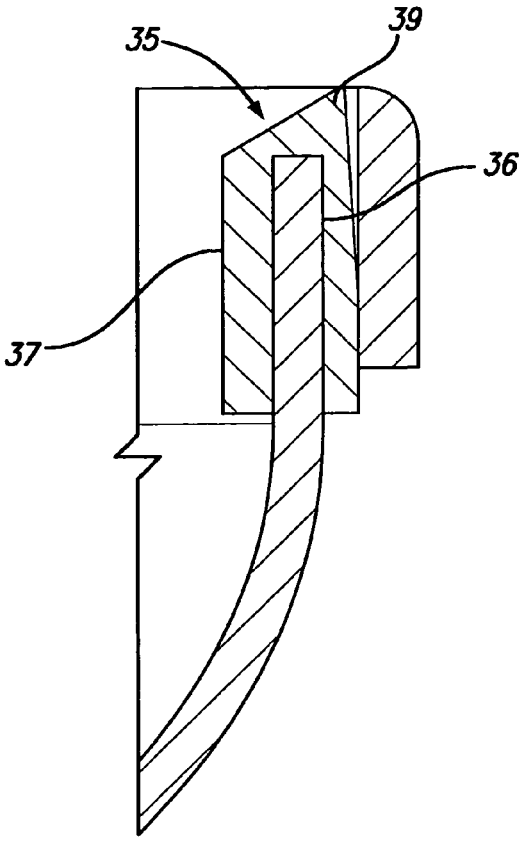
FIG. 6A is an enlarged cross-sectional view of an alternative embodiment of the improved musical instrument, in accordance with the present invention shown with the drumhead and the drumshell engaged in airtight relation and the bearing edge engaging the drumhead.
Figure 6B:
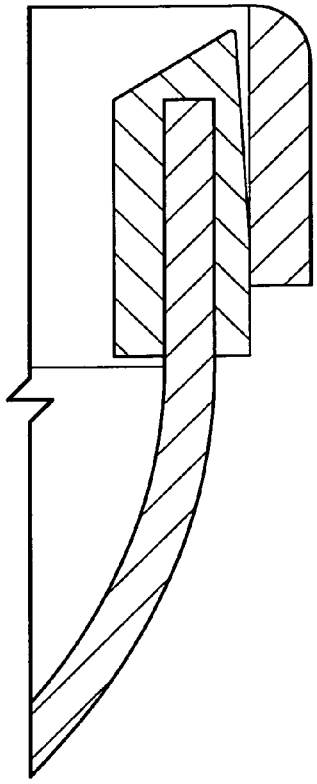
FIG. 6B is an enlarged cross-sectional view of an alternative embodiment of the improved musical instrument in accordance with the present invention shown with the drumhead and the drumshell engaged in airtight relation and a space between the bearing edge and the drumhead.

For hollow shell 18 with relatively thin sidewalls (e.g. ⅛"-3/16"), tapered coupling member 36 can be cast as a single integrated piece 35 united with bearing edge 39 and support member 37, which is provided to give added strength and rigidity to hollow shell 18, specifically when tapered coupling member 36 and hollow shell 18 join to form the airtight seal (see FIGS. 6A, 6B). Normally, single piece 35 is formed integrally with hollow shell 18 employing a conventional cast resin process for uniting the two components to achieve the requisite strength and rigidity necessary to withstand the potentially destructive compression forces that might occur when frame member 16 and hollow shell 18 are joined to form a tight fitting juncture and sidewall 11 is urged laterally outward. Single piece 35 can likewise be joined with shell 18 employing various other means, including, but not limited to, adhesives or some type of mechanical means to attach the two, including the use of nails, rivets, staples and screws (not shown).

Figure 9A:
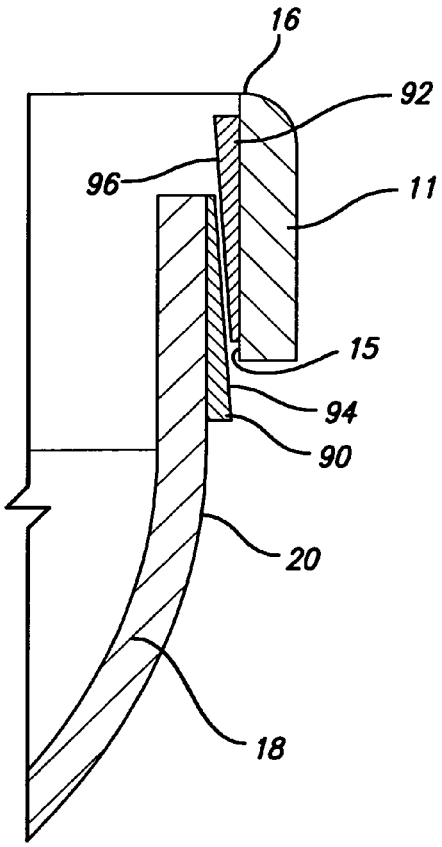
FIGS. 9A-9B are enlarged cross-sectional views of a section of an alternative embodiment of the musical instrument in accordance with the present invention showing mating tapered couplings employed to join the drumhead and the drumshell in airtight relation.
Figure 9B:
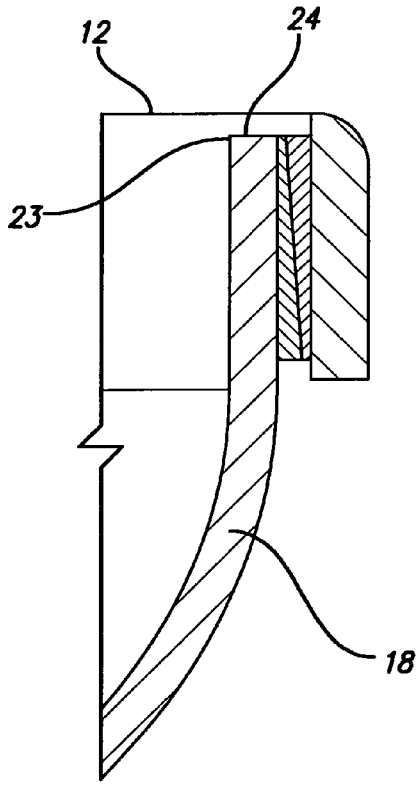
Figure 10A:
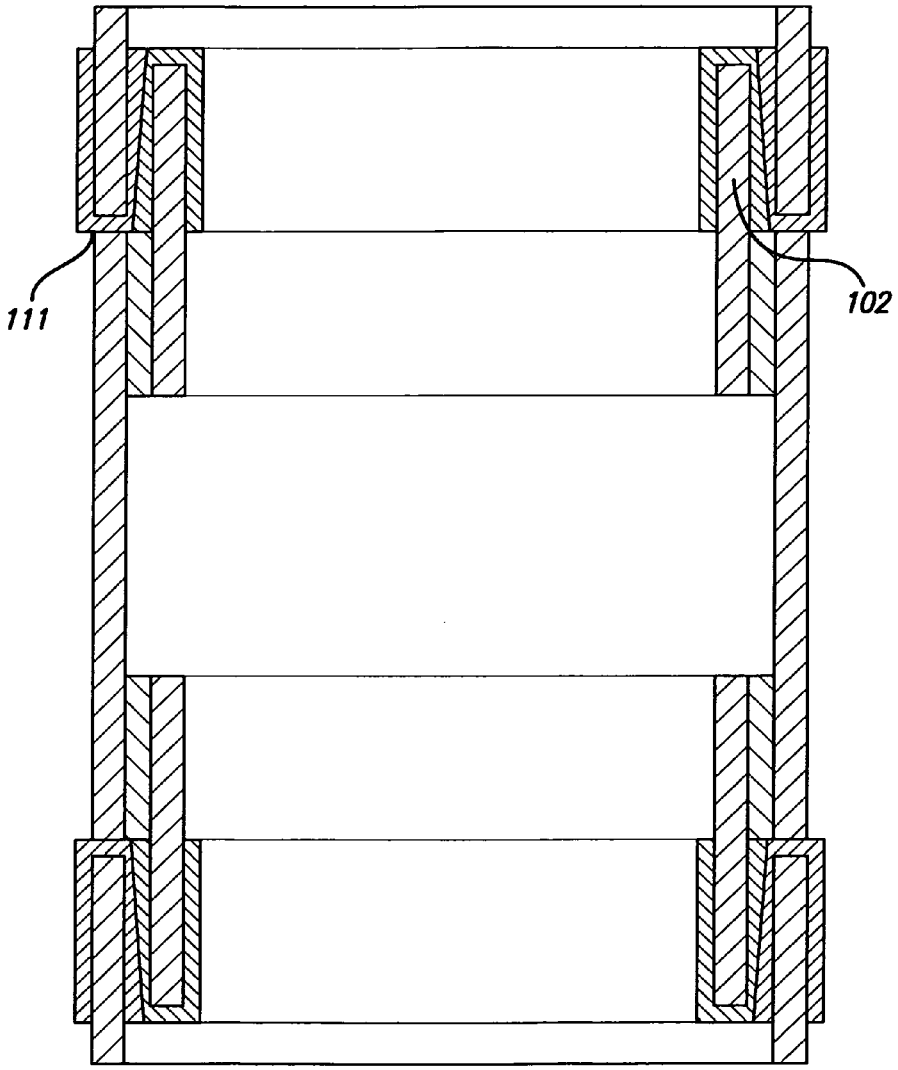
FIG. 10A is a cross-sectional view of another alternative embodiment of the improved musical instrument in accordance with the present invention showing the mated u-shaped tapered couplings employed to join the drumhead and the drumshell in sealing airtight relation.
Figure 10B:
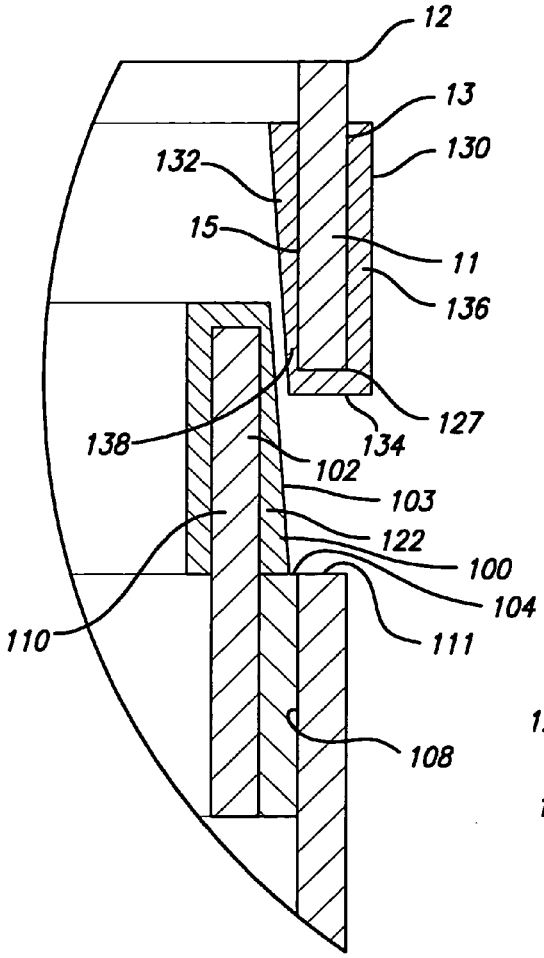
FIG. 10B is an enlarged cross-sectional view of a section of the improved musical instrument shown in FIG. 10A with the drumhead and the drumshell shown in initial engagement in accordance with the present invention.
Figure 10C:
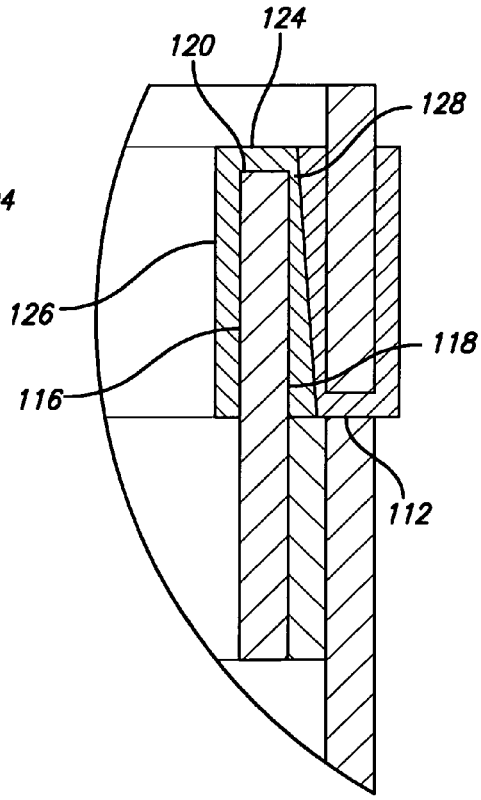
FIG. 10C is an enlarged cross-sectional view of a section of the improved musical instrument shown in FIG. 10A with the drumhead and the drumshell shown in the final stage of engagement in sealing airtight relation in accordance with the present invention.
Figure 10D:
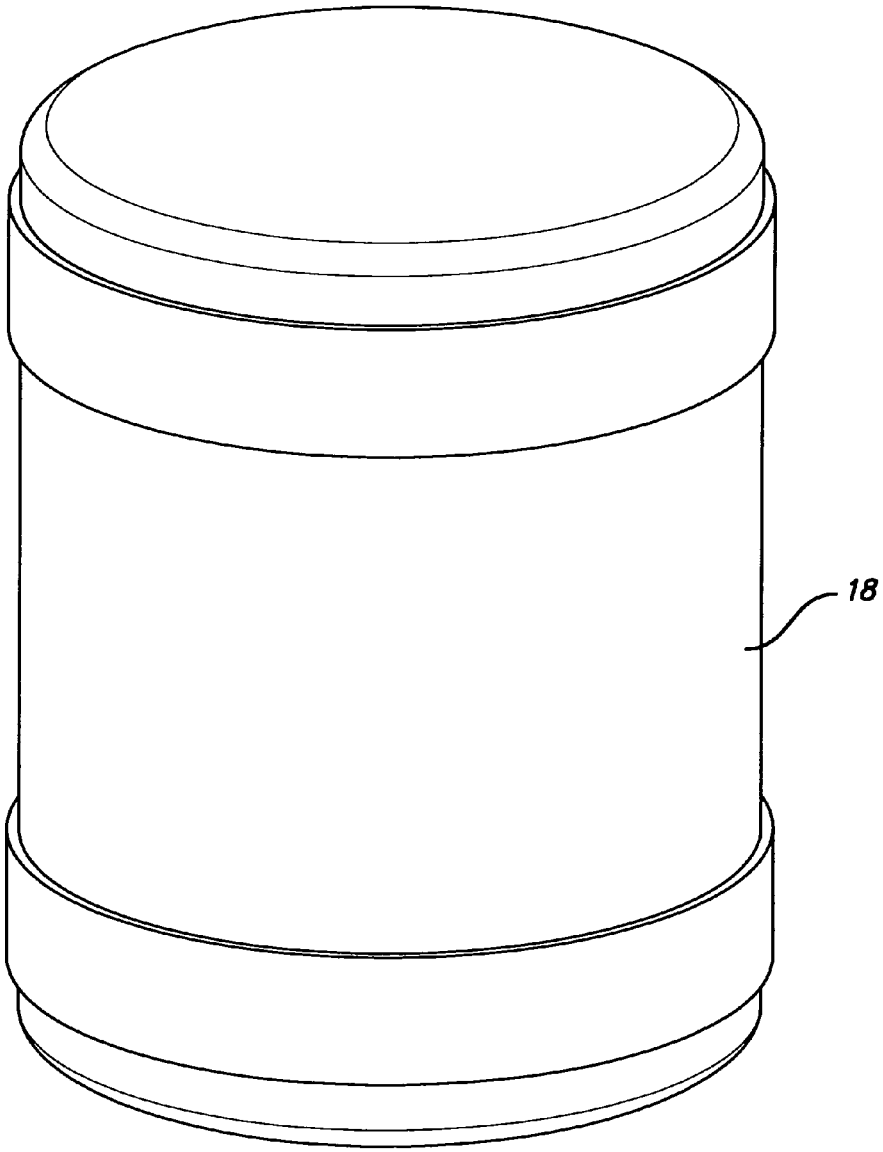
FIG. 10D is a perspective view of the alternative embodiment of the improved musical instrument in accordance with the present invention shown in cross-section in FIG. 10A.

Another alternative embodiment of the improved musical instrument 10 in accordance with the present invention comprises first tapered coupling member 90 disposed, either integrally or as an attachment, upon outside surface 20 of hollow shell 18 and mateable second tapered coupling member 92 disposed, either integrally or as an attachment, upon inner surface 15 of sidewall 11 of frame member 16. As shown in FIGS. 9A and 9B, head member 12 is mounted upon end member 24 of hollow shell 18 and the two are then brought together with their opposing surfaces 94 and 96, respectively, mating in frictional engagement to establish an airtight seal.

Another alternative embodiment of the improved musical instrument 10 in accordance with the present invention, as shown in FIGS. 10A-10D, comprises a u-shaped coupling member 100 that integrates with at least one projecting member 102, which further integrates with sidewall 103 of at least one end 104 of hollow shell 18. Projecting member 102 joins with inside surface 108 of hollow shell 18 with section 110 of projecting member 102 extending beyond peripheral edge 112 to form annular shoulder 111. Projecting member 102 includes interior surface 116, exterior surface 118 and annular top edge 120.

U-shaped coupling member 100 includes tapered section 122, which integrates with exterior surface 118, circumferential bearing edge 124, which integrates with annular top edge 120, and rigid support member 126, which integrates with interior surface 116. The most tapered, i.e. thinnest, end 128 of tapered section 122 is located generally adjacent or in near proximity to annular top edge 124 and gradually widens as tapered section 122 extends along exterior surface 118 in the direction away from annular top edge 124.

U-shaped coupling member 130 is adapted to join with head member 12 by integrating with sidewall 11. Specifically, u-shaped coupling member 130 includes tapered section 132, which integrates with inner surface 15, circumferential rim 134, which integrates with bottom edge 27 and rigid support member 136, which integrates with outer surface 13. The most tapered, i.e. thinnest, end 138 of tapered section 132 is located generally adjacent or in near proximity to bottom edge 27 and gradually widens as tapered section 132 extends along surface 15 in the direction away from bottom edge 27.

By bringing u-shaped coupling members 100 and 130 together, the requisite airtight fit is realized. Specifically, head member 12 with integrated u-shaped coupling member 130 incorporated around sidewall 11 is mounted on hollow shell 18 by engaging projecting member 102 with integrated u-shaped coupling member 100, incorporated around projecting member 102, as shown. Mating tapered sections 122 and 132 are brought together until they are substantially, if not completely, face opposed and form an airtight fit with circumferential rim 134 seated firmly on annular shoulder 111.

The preferred angles of slope of tapered section 122 and tapered section 132 is 2 degrees, though these slope angles may vary.

U-shaped coupling member 100 may be attached to or integrated with projecting member 102 either adhesively, or by employing any other suitable mechanical means, such as, for example, nails, staples or screws. U-shaped coupling member 100 may also be integrally formed with projecting member 102 employing a cast resin mold process, which may employ the use of spaced holes formed in alignment through u-shaped coupling member 100 and hollow shell 18 (not shown) to enable the cast urethane to flow through and harden, and then lock the two securely. Other methods suitable to mold or bind the two components may also be appropriate.

U-shaped coupling member 130 may be attached to or integrated with head member 12 employing the same means and methods, as immediately heretofore described.

Figure 11A:
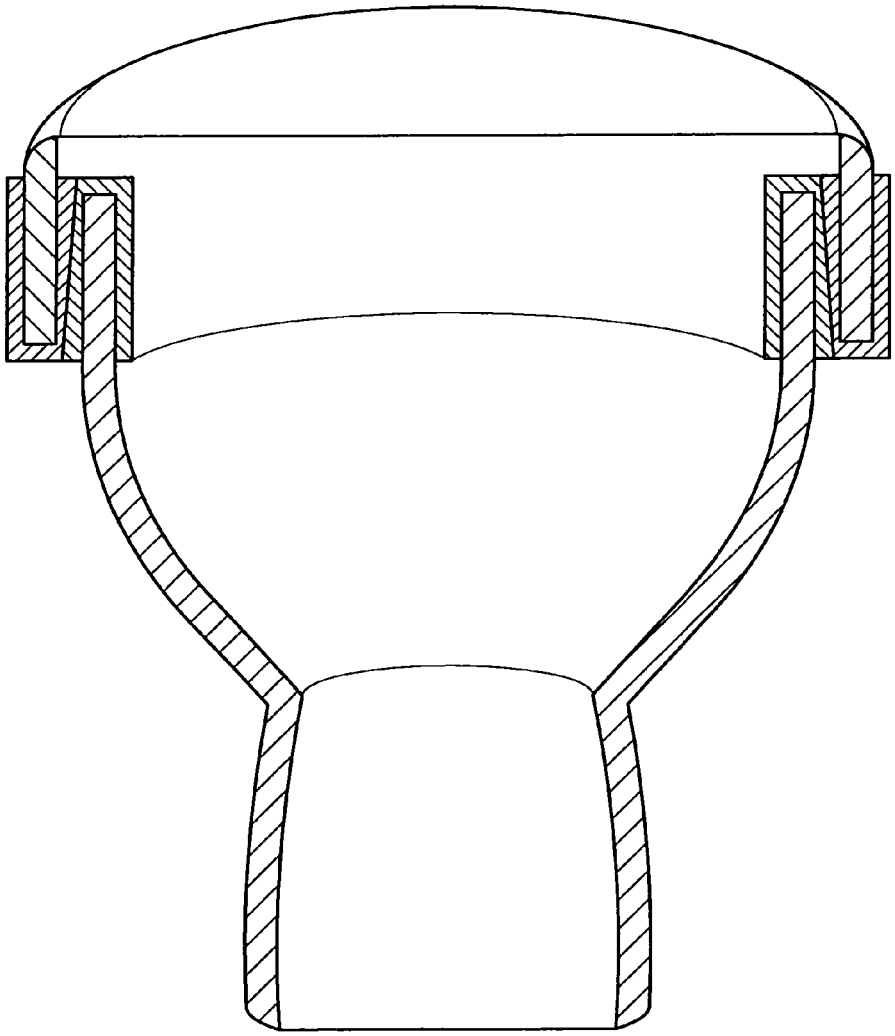
FIG. 11A is a cross-sectional view of another alternative embodiment of the improved musical instrument in accordance with the present invention showing the mated u-shaped tapered couplings employed to join the drumhead and the drumshell in sealing airtight relation.
Figure 11B:
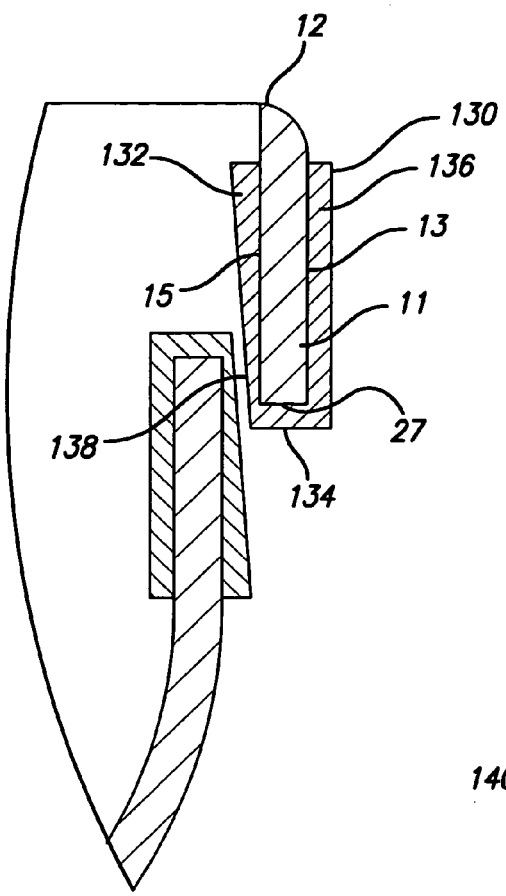
FIG. 11B is an enlarged cross-sectional view of a section of the improved musical instrument shown in FIG. 11A with the drumhead and the drumshell shown in initial engagement in accordance with the present invention.
Figure 11C:
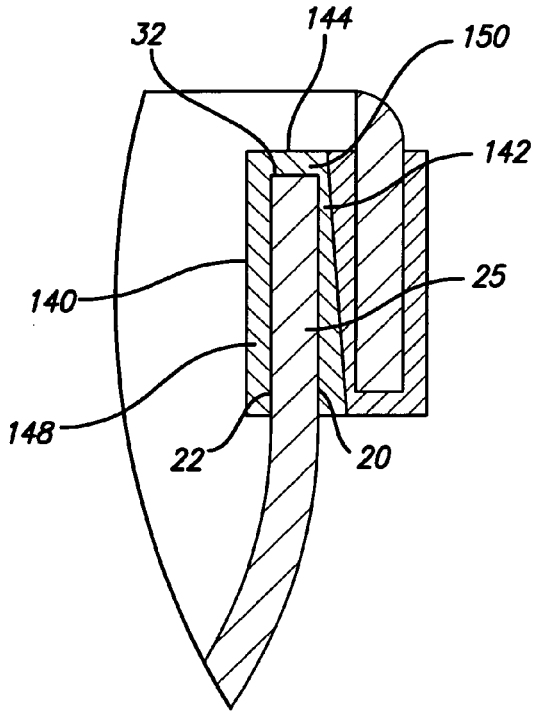
FIG. 11C is an enlarged cross-sectional view of a section of the improved musical instrument shown in FIG. 11A with the drumhead and the drumshell shown in the final stage of engagement in sealing airtight relation in accordance with the present invention.

Another alternative embodiment of the improved musical instrument 10 in accordance with the present invention, as shown in FIGS. 11A-11C, comprises a u-shaped coupling member 130 adapted to integrate with head member 12 by incorporating itself around sidewall 11. Specifically, u-shaped coupling member 130 includes tapered section 132, which integrates with inner surface 15, circumferential rim 134, which integrates with bottom edge 27 and rigid support member 136, which integrates with outer surface 13. The most tapered, i.e. thinnest, end 138 of tapered section 132 is located generally adjacent or in near proximity to bottom edge 27 and gradually widens as tapered section 132 extends along surface 15 in the direction away from bottom edge 27.

Also provided is u-shaped coupling member 140 adapted to integrate with hollow shell 18. U-shaped coupling member 140 includes tapered section 142, which integrates with outside surface 20, peripheral edge 144, which integrates with circumferential bearing edge 32, and rigid support member 148, which integrates with inside surface 22. Tapered section 142 has its most tapered, i.e. thinnest, end 150 in near proximity or generally adjacent to circumferential bearing edge 32 and gradually widens as tapered section 142 extends along sidewall 25 in the direction away from circumferential bearing edge 32.

By bringing u-shaped coupling members 130 and 140 together, the requisite airtight fit is realized. Specifically, head member 12 with u-shaped coupling member 130 incorporated around sidewall 11 is mounted on hollow shell 18 by engaging u-shaped coupling 140 incorporated around sidewall 25, as shown. Mating tapered sections 132 and 142 converge until they are substantially, if not completely, face opposed and form an airtight fit.

The preferred angles of slope of tapered section 132 and tapered section 142 is 2 degrees, though these slope angles may vary.

U-shaped coupling member 130 may be attached to or integrated with head member 12 either adhesively, or by employing any other suitable mechanical means, such as, for example, nails, staples, or screws. U-shaped coupling member 130 may also be integrally formed with head member 12 by employing a cast resin mold process, which may employ the use of spaced holes formed in alignment through u-shaped coupling member 130 and hollow shell 18 (not shown) to enable a cast urethane to flow through and harden, and then lock the two securely. Other methods suitable to mold or bind the two components may also be appropriate.

U-shaped coupling member 140 may be attached to or integrated with hollow shell 18 employing the same means and methods, as immediately heretofore described.

Figure 5:
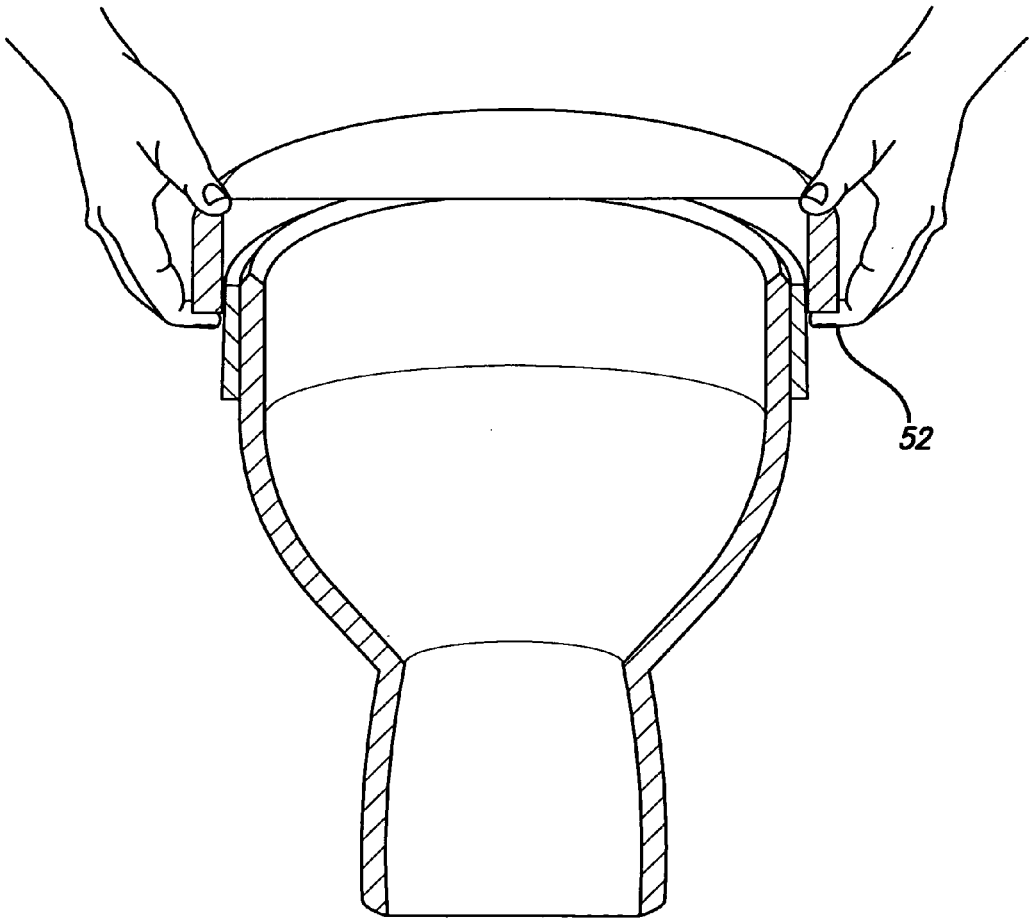
FIG. 5 is a cross-sectional view of the improved musical instrument in accordance with the present invention demonstrating the head being lifted from the drumshell.

One method for removing head member 12 from hollow shell 18 is by using fingers 52 positioned on opposite sides of head member 12 to lift and to pry it loose from hollow shell 18 until the two components separate (see FIG. 5). Another method for separating the two involves the use of a mechanical device such as, for example, a wrench-like pry bar 60, which engages bolt 62 protruding typically from multiple locations (not shown), situated at intervals along outside surface 20 of hollow shell 18. Pry bar 60 is comprised of handle 64, one or more openings, such as openings 66 and 67, either of which fits conformably over bolt 62 (shown in FIGS. 7A through 7G) and end member 69, which is normally oval in shape, but which may be configured differently, if desired, to enable the tool to adapt accordingly.

Figure 7A:
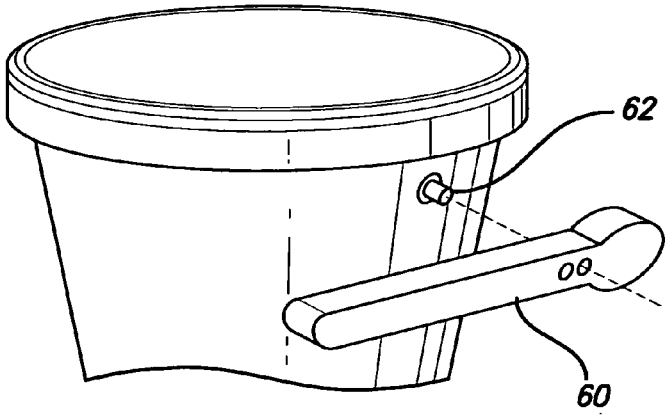
FIGS. 7A-7G are perspective views of the improved musical instrument in accordance with the present invention demonstrating the use of a mechanical device to lift and separate the drumhead from the drumshell, including a view of the device by itself and in cross section in combination with a drumshell.
Figure 7B:
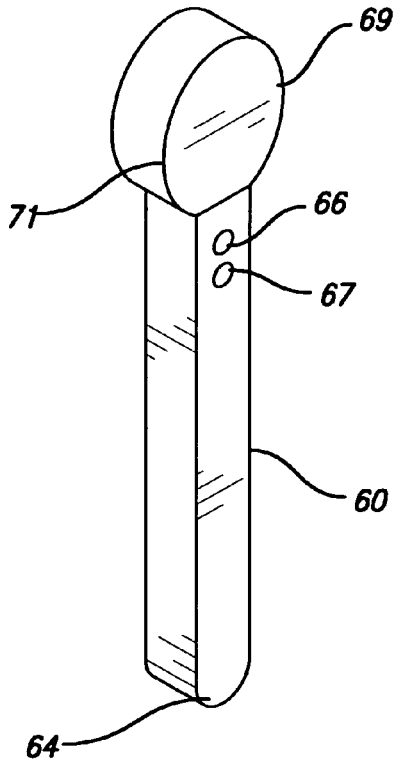
Figure 7C:
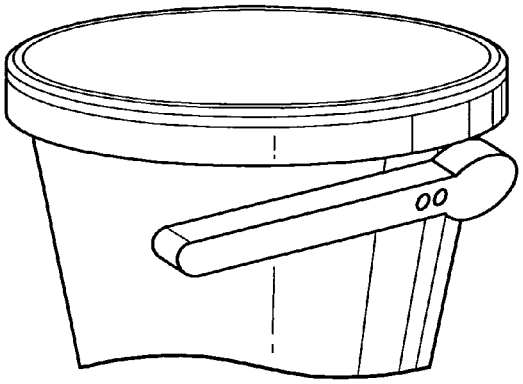
Figure 7D:
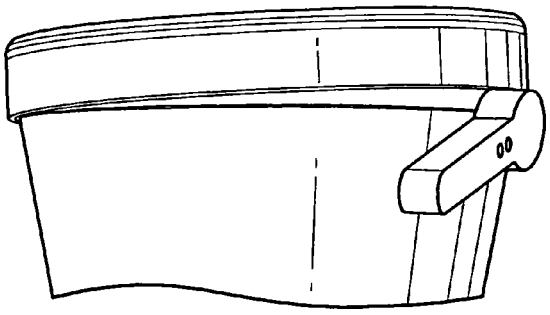
Figure 7E:
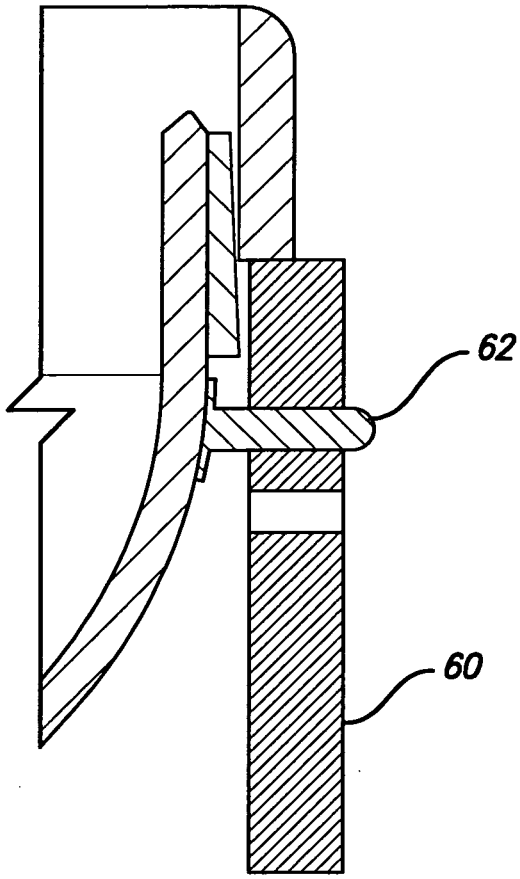
Figure 7F:
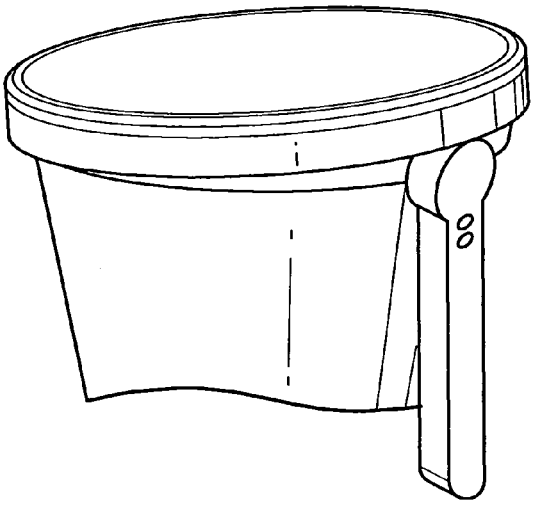
Figure 7G:
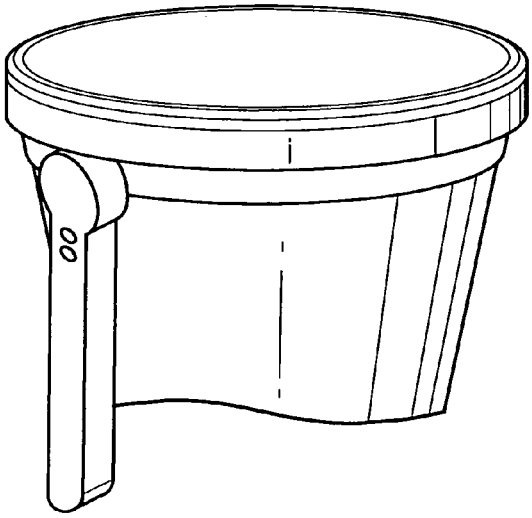
Figure 8A:
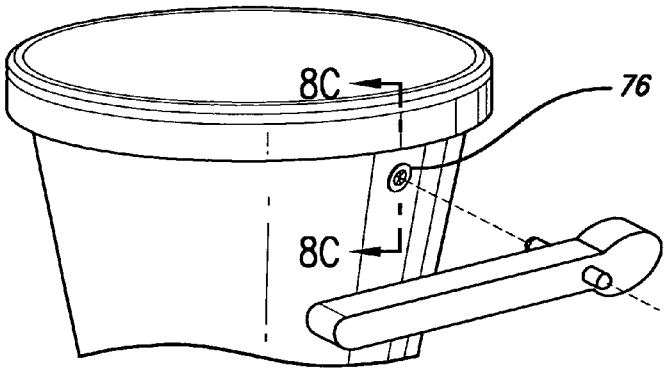
FIGS. 8A-8D are perspective views of the improved musical instrument in accordance with the present invention showing an alternative embodiment of the mechanical device and method used to lift and separate the drumhead from the drumshell.
Figure 8B:
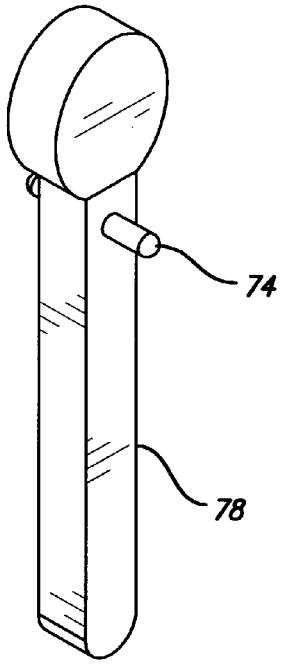
Figure 8C:
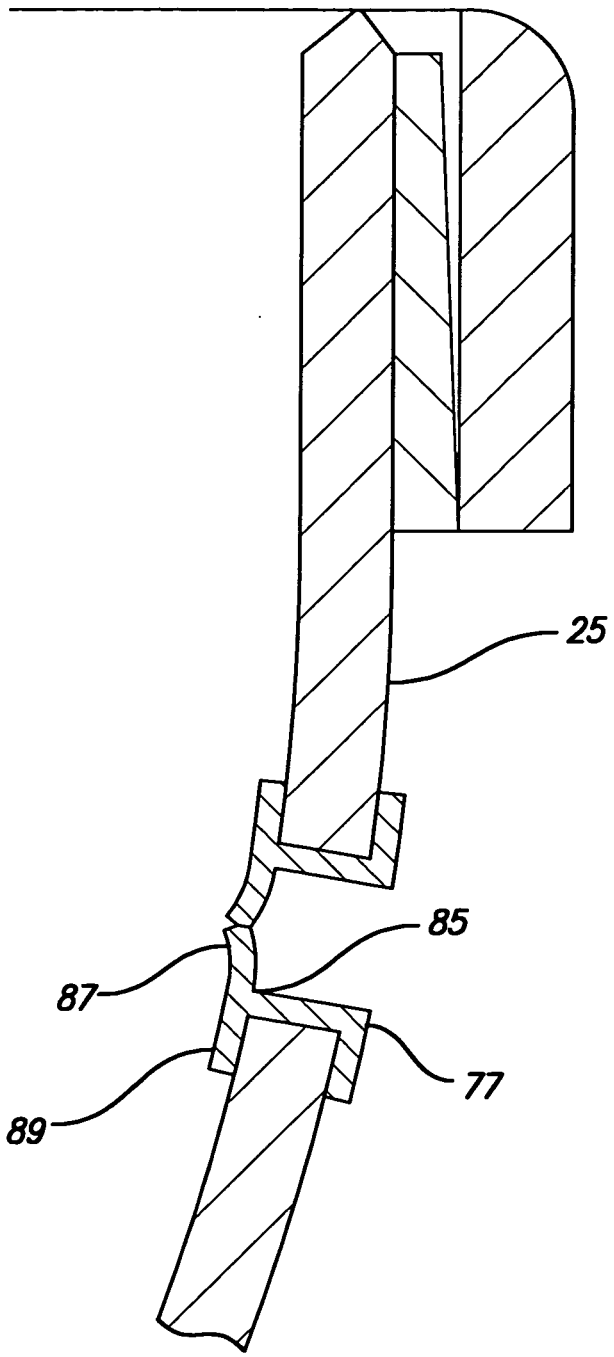
Figure 8D:
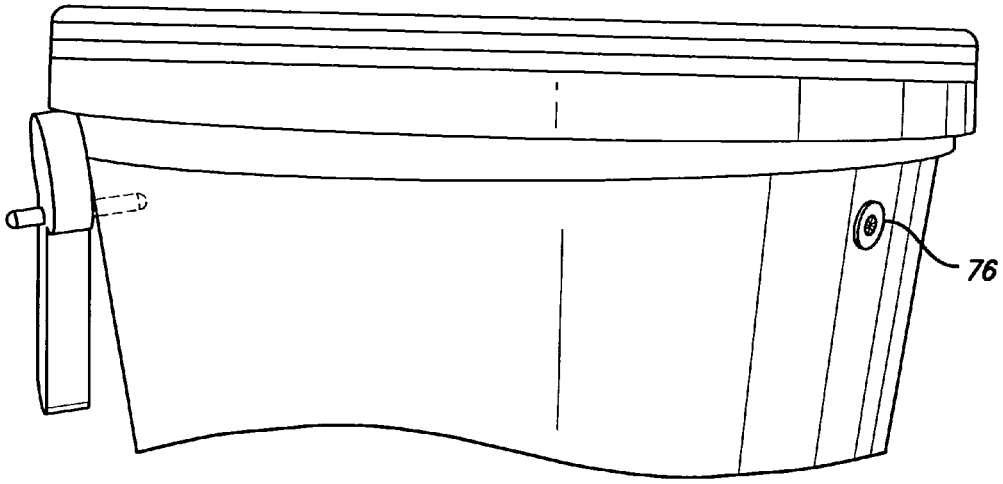

In most applications, end member 69 and handle 64 are equally thick along the entire length of the tool, and require only slight lateral manipulation for end member 69 to properly align itself with and engage bottom edge 27. In some applications, where hollow shell 18 is especially angular along the upper areas of its sidewall, end member 69 might incorporate along its side section 71 a slight relief area or shoulder (not shown) to accommodate for the slope of the sidewall and to enable end member 69 to engage coupling member 36 more effectively. Either opening 66 or opening 67 may be used to create the fulcrum point with bolt 62 depending upon which combination is determined to be the most effective for lifting head member 12 from hollow shell 18. Thus, in its typical application, opening 66 or 67 is caused to releasably engage bolt 62. Pry bar 60 is then manipulated to pivot downward, causing end member 69 to engage bottom edge 27 of frame member 16 and lift head member 12 from hollow shell 18 (FIGS. 7C and 7D). Pry bar 60 then may engage one or more additional bolts 62 located at various other points upon outside surface 20 of hollow shell 18 to loosen the connection between head member 12 and hollow shell 18, eventually separating the two.

An alternative version of the method employing pry bar 60 includes a similar lever device 78, except that integrated therein or employed as an attachment is projecting pin 74, which is designed to fit conformally into one or more openings 76 formed through or within sidewall 25 of hollow shell 18, as shown in FIGS. 8A through 8D. Each opening 76 comprises a ferrule 77 attached to shell 18 with a one-way push nut 85, which is self-sealing with a gasket-like member 87 formed at one end 89 to prevent the escape of air from inside the chamber of hollow shell 18. This alternative may be more aesthetically appealing compared to the employment of bolts 62, which can be invasive. Once lever 78 engages one or more openings 76 in this fashion, the method for lifting and separating head member 12 from hollow shell 18 is essentially the same. Lever 78 continues to work around hollow shell 18 where the various openings 76 are positioned until head member 12 lifts sufficiently off hollow shell 18 so that it can be easily separated and removed.

Hollow shell 18 can comprise a musical drumshell, as already described, and also the framed head portion of a banjo (not shown), a tambourine shell (not shown) and a variety of other percussion instruments that produce sounds, particularly musical sounds, when the playing surface formed over the top or attached to the end of the shell or similar item is struck by a hand or any type of handheld object.

In some applications of the present invention tuning hardware may be provided (not shown) to increase or decrease pitch either within chamber 21 of hollow shell 18 (e.g. tuning screws, not shown) or hollow shell 18 attached to outside surface 20 and then connected to corresponding hardware (not shown) attached to frame member 16 to tune musical instrument 10 more precisely.

Bearing edges, such as, for example, circumferential bearing edge 32 and bearing edge 39, are generally formed with a relatively sharp or pointed edge. Other bearing edges, such as the one formed at the top edge 23 of first end 24, are generally flat. Flat-edged surfaces, when they engage the underside of a drumhead, typically have a greater dampening effect upon the drum sounds than a honed edged surface does.

While the invention will be described in connection with a certain preferred embodiment, it is understood that it is not intended to limit the invention to that particular one. Rather, it is intended to cover all alternatives, modifications and equivalents as may be included within the spirit and scope of the invention as defined by the appended claims.

The invention claimed is:

1. In a musical instrument with a hollow shell having one or more openings, the improvement comprising:

a head member, said head member having a playing surface, said playing surface having an underside, and an annular frame member attached to said playing surface, said annular frame member having a bottom edge;

a hollow shell, said hollow shell having a sidewall with an outside surface and an inside surface, and at least one end defining an opening, said opening having a circumferential edge portion;

a tapered coupling member, said tapered coupling member being disposed upon said outside surface of said hollow shell with the most tapered end of said tapered coupling member disposed in near proximity or generally adjacent to said circumferential edge portion gradually widening as said tapered coupling member extends along said outside surface of said hollow shell in the direction away from said circumferential edge portion;

said head member being mountable upon said end of said hollow shell wherein said head member and said hollow shell are slidably disposed to frictionally engage, enabling said head member and said hollow shell to establish an airtight fit and the transfer of energy produced upon the striking of said playing surface from said head member to said hollow shell to enhance the fullness, sound and resonant bass tones of said musical instrument.

2. The musical instrument of claim 1 wherein said circumferential edge portion is a circumferential bearing edge.

3. The musical instrument of claim 1 wherein said tapered coupling member is attached circumferentially to said outside surface of said hollow shell.

4. The musical instrument of claim 1 wherein said tapered coupling member is cast integrally with the material from which said hollow shell is fabricated.

5. The musical instrument of claim 1 wherein said tapered coupling member is molded to said hollow shell.

6. The musical instrument of claim 3 wherein said tapered coupling member is adhesively attached to said outside surface of said hollow shell.

7. The musical instrument of claim 3 wherein said tapered coupling member is attached to said outside surface of said hollow shell with fastener means from the group comprised of nails, tacks, staples and screws.

8. The musical instrument of claim 1 wherein said hollow shell is a musical drum shell.

9. The musical instrument of claim 1 wherein said hollow shell comprises the shell portion of a tambourine.

10. The musical instrument of claim 1 wherein said hollow shell comprises the frame portion of a banjo.

11. The musical instrument of claim 1 wherein said tapered coupling member has a height range of ½" to 5".

12. The musical instrument of claim 1 wherein said tapered coupling member comprises an angle of slope of less than 6 degrees.

13. The musical instrument of claim 1 wherein said tapered coupling member is comprised of a rigid synthetic material.

14. The musical instrument of claim 1 wherein said tapered coupling member includes a radius projection that contacts the outer periphery of said underside for dampening high frequencies.

15. The musical instrument of claim 1 wherein said hollow shell is comprised of materials from the group that includes a composite of wood fiber and resin, wood, fiberglass and plastic.

16. The musical instrument of claim 1 wherein said hollow shell has a wall thickness range of ⅛" to 5/16".

17. The musical instrument of claim 1 wherein said hollow shell is comprised of a rigid material.

18. The musical instrument of claim 1 wherein said playing surface comprises a vibrating membrane.

19. The musical instrument of claim 1 wherein playing surface is a drumhead.

20. The musical instrument of claim 1 wherein said head member engages said tapered coupling member in overlapping contact relation, urging said head member towards said hollow shell until said tapered coupling member and said hollow shell meet sufficient resistance to ensure an airtight fit.

21. The musical instrument of claim 1 wherein means are employed for tuning said playing surface to increase or decrease the sound pitch produced upon the striking of said playing surface.

22. The musical instrument of claim 21 wherein said tuning means are employed on said outside surface of said hollow shell in contact relation with a first cooperating tuning means attached directly or indirectly to said playing surface.

23. The musical instrument of claim 21 wherein said tuning means are employed from a position located on said inside surface of said hollow shell in contact relation with a second cooperating tuning means attached directly or indirectly to said playing surface.

24. In a musical instrument with a hollow shell having one or more openings, the improvement comprising:

a head member, said head member having a playing surface and an annular frame member attached to said playing surface, said annular frame member having a sidewall with an inner surface and an outer surface, and a bottom edge;

a hollow shell, said hollow shell having a sidewall with an outside surface and an inside surface, and a first end defining a first opening and a second end defining a second opening, with at least one said opening having a circumferential bearing edge portion;

a tapered coupling member, said tapered coupling member being disposed upon said outside surface of said hollow shell with the most tapered end of said tapered coupling member disposed in near proximity or generally adjacent to said circumferential edge portion gradually widening as it extends along said outside surface of said hollow shell in the direction away from said circumferential edge portion;

said head member being mountable upon at least one said end of said hollow shell wherein said head member and said hollow shell are adapted to releasably engage to enable said head member and said hollow shell to establish an airtight fit and the transfer of energy produced upon the striking of said playing surface from said head member to said hollow shell to enhance the fullness, sound and resonant bass tones of said musical instrument.

25. In a musical instrument with a hollow shell having one or more openings, the improvement comprising:

a head member, said head member having a playing surface and an annular frame member attached to said playing surface, said annular frame member having a sidewall, said sidewall having an inner surface and an outer surface, and a bottom edge;

a hollow shell, said hollow shell having a sidewall with an upper bearing edge, an outside surface, an inside surface, and at least one end defining an opening;

a tapered coupling member, said tapered coupling member having a tapered section being disposed upon said outside surface of said hollow shell with the most tapered end of said tapered section being disposed in near proximity or generally adjacent to said upper bearing edge gradually widening as it extends along said outside surface of said hollow shell in the direction away from said upper bearing edge, said tapered coupling member further comprising a circumferential bearing edge attached to or integrally formed with said tapered section and a rigid support member attached to or integrally formed with said circumferential bearing edge, said rigid support member disposed in opposed parallel relation with said tapered section along said inside surface of said hollow shell to give strength to said sidewall;

said head member being mounted upon at least one said end of said hollow shell wherein said head member and said hollow shell are slidably disposed to frictionally engage enabling said inner surface of said sidewall and said tapered section to converge in face opposed contact relation and establish an airtight fit and the transfer of energy produced upon the striking of said playing surface from said head member to said hollow shell to enhance the fullness, sound and resonant bass tones of said musical instrument.

26. The musical instrument of claim 25 wherein said tapered section, said circumferential bearing edge and said rigid support member are integrally formed with said sidewall employing a cast resin mold process.

27. The musical instrument of claim 25 wherein said tapered section, said circumferential bearing edge, and said rigid support member are adhesively attached to said sidewall.

28. The musical instrument of claim 25 wherein said integrally formed elements comprising said tapered coupling member, said circumferential bearing edge, and said rigid support member are attached to said sidewall using mechanical means from the group comprised of tacks, nails, staples, rivets and screws.

29. The musical instrument of claim 1 wherein disposed upon said outside surface of said hollow shell are one or more projecting pins, said head member being adapted for removal from said hollow shell with the use of means to lift and separate said head member from said hollow shell, said means comprising a tool member having a handle, an end section and at least one opening for releasable engagement with at least one of said projecting pins to establish a fulcrum, whereupon said handle is pushed downward to enable said end section to pivot upward and engage said bottom edge to lift said frame member from said shell.

30. The musical instrument of claim 1 wherein said hollow shell includes one or more openings in said sidewall, said head member being adapted for removal from said hollow shell with the use of means to lift and separate said head member from said hollow shell, said means comprising a tool member having a handle, an end section, and a pin projecting from said end section for releasable engagement with one or more of said openings to establish a fulcrum, whereupon said handle is pushed downward to enable said end section to pivot upward and engage said bottom edge to lift said frame member from said shell.

31. The musical instrument of claim 30 wherein said openings are self-sealing at one end.

32. The musical instrument of claim 1 wherein said sidewall of said hollow shell converges generally inward from said bearing edge.

33. In a musical instrument with a hollow shell having one or more openings, the improvement comprising:

a head member, said head member having a playing surface and an annular frame member attached to said playing surface, said annular frame member having a sidewall with an outer surface and an inner surface, and a bottom edge;

a hollow shell, said hollow shell having a sidewall with an outside surface and an inside surface, and at least one end defining an opening, said opening having an edge portion;

a first tapered coupling member, said first tapered coupling member being disposed upon said outside surface of said hollow shell with the most tapered end of said first tapered coupling member disposed in near proximity or generally adjacent to said edge portion gradually widening as said first tapered coupling member extends along said outside surface in the direction away from said edge portion;

a second tapered coupling member, said second tapered coupling member being disposed upon said inner surface of said annular frame member sidewall with the most tapered end of said second tapered coupling member being disposed in near proximity or generally adjacent to said bottom edge gradually widening as said second tapered coupling member extends along said inner surface of said frame member sidewall in the direction away from said bottom edge;

said head member being mounted upon at least one said end of said hollow shell wherein said first tapered coupling member and said second tapered coupling member are slidably disposed to frictionally engage to enable said first tapered coupling member and said second tapered coupling member to converge in face opposed contact relation and establish an airtight fit and the transfer of energy produced upon the striking of said playing surface from said head member to said hollow shell to enhance the fullness, sound and resonant bass tones of said musical instrument.

34. In a musical instrument with a hollow shell having one or more openings, the improvement comprising:

at least one head member, said head member having a playing surface and an annular frame member attached to said playing surface, said annular frame member having a sidewall with an outer surface and an inner surface, and a bottom edge;

a hollow shell, said hollow shell having a sidewall with an outside surface and an inside surface, and at least one end with a circumferential bearing edge defining an opening;

a first u-shaped coupling member, said first u-shaped coupling member being adapted to join with said hollow shell, said first u-shaped coupling member having a first tapered section disposed to integrate with said outside surface of said sidewall, a peripheral edge disposed to integrate with said circumferential bearing edge, and a first rigid support member disposed to integrate with said inside surface of said sidewall, said first tapered section having its most tapered end in near proximity or generally adjacent to said opening and gradually widening as said first tapered section extends along said sidewall in the direction away from said circumferential bearing edge;

a second u-shaped coupling member being adapted to join with said head member, said second u-shaped coupling member having a second tapered section disposed to integrate with said inner surface of said sidewall, a circumferential rim disposed to integrate with said bottom edge, and a second rigid support member disposed to integrate with said outside surface of said sidewall, said second tapered section having its most tapered end in near proximity or generally adjacent to said bottom edge and gradually widening as said second tapered section extends along said sidewall in the direction away from said bottom edge;

said head member being slidably mounted upon at least one end of said hollow shell wherein said first u-shaped coupling member and said second u-shaped coupling member converge to enable said first tapered section and said second tapered section to frictionally engage in mating face opposed sealing relation to establish an airtight releasable connection.

35. The musical instrument of claim 34 wherein the angle of the slope of said first tapered section and said second tapered section is 2 degrees.

36. The musical instrument of claim 34, wherein said first u-shaped coupling member is integrally formed with said hollow shell employing a cast resin mold process.

37. The musical instrument of claim 34, wherein said second u-shaped coupling member is integrally formed with said head member employing a cast resin mold process.

38. The musical instrument of claim 34, wherein said first u-shaped coupling member is attached adhesively to said hollow shell.

39. The musical instrument of claim 34, wherein said second u-shaped coupling member is attached adhesively to said head member.

40. In a musical instrument with a hollow shell having on or more openings, the improvement comprising:

at least one head member, said head member having a playing surface and an annular frame member attached to said playing surface, said annular frame member having a sidewall with an outer surface and an inner surface, and a bottom edge;

a hollow shell, said hollow shell having a sidewall with an outside surface and an inside surface and at least one end with a circumferential bearing edge defining an opening;

at least one projecting member, said projecting member being adapted to integrate with said inside surface of said sidewall of said hollow shell with a section of said projecting member extending beyond said circumferential bearing edge for forming an annular shoulder, said projecting member having an exterior surface, an annular top edge and an interior surface;

a first u-shaped coupling member, said first u-shaped coupling member being adapted to integrate with said projecting member, said first u-shaped coupling member having a first tapered section disposed to integrate with said exterior surface of said projecting member, a peripheral edge disposed to integrate with said annular top edge, and a rigid support member disposed to integrate with said interior surface of said projecting member, said first tapered section having its most tapered end in near proximity or generally adjacent to said annular top edge and gradually widening as said first tapered section extends along said exterior surface in the direction away from said annular top edge;

a second u-shaped coupling member being adapted to integrate with said head member, said second u-shaped coupling member having a second tapered section disposed to integrate with said inner surface of said sidewall of said head member, a circumferential rim disposed to integrate with said bottom edge, and a second rigid support member disposed to integrate with said outer surface of said sidewall of said head member, said second tapered section having its most tapered end in near proximity or generally adjacent to said bottom edge and gradually widening as said second tapered section extends along said sidewall in the direction away from said bottom edge;

said head member being slidably mounted upon at least one said projecting member wherein said first u-shaped coupling member and said second u-shaped coupling member converge to enable said first tapered section and said second tapered section to frictionally engage in mating face opposed sealing relation to establish an airtight releasable connection.

41. The musical instrument of claim 40, wherein the angle of the slope of said first tapered section and said second tapered section is 2 degrees.

42. The musical instrument of claim 40, wherein said first u-shaped coupling member is integrally formed with said projecting member employing a cast resin mold process.

43. The musical instrument of claim 40, wherein said second u-shaped coupling member is integrally formed with said head member employing a cast resin mold process.

44. The musical instrument of claim 40, wherein said first coupling member is adhesively attached to said projecting member.

45. The musical instrument of claim 40, wherein said second coupling member is adhesively attached to said head member.

46. The musical instrument of claim 40, wherein said annular shoulder is adapted to support said head member when said head member engages said projecting member in seated relation.

* * * * *

UNITED STATES PATENT AND TRADEMARK OFFICE

CERTIFICATE OF CORRECTION

PATENT NO. : 8,642,866 B1
APPLICATION NO. : 13/573864
DATED : February 4, 2014
INVENTOR(S) : Remo D. Belli, James H. May and Christopher J. Whittington It is certified that error appears in the above-identified patent and that said Letters Patent is hereby corrected as shown below:

On the Title Page

Related U.S. Application Data should read,
Item [63] Continuation-in-Part of application No. 13/573,146 filed on August 27, 2012, now abandoned Signed and Sealed this
Twenty-eighth Day of October, 2014

Michelle K. Lee

Michelle K. Lee
*Deputy Director of the United States Patent and Trademark Office*